US007198015B2

(12) United States Patent
Mobley

(10) Patent No.: US 7,198,015 B2
(45) Date of Patent: Apr. 3, 2007

(54) VARIABLE VALVE TIMING SYSTEM

(76) Inventor: George Wayne Mobley, 2759 Deford Mill Rd., Hampton Cove, AL (US) 35763

( * ) Notice: Subject to any disclaimer, the term of this patent is extended or adjusted under 35 U.S.C. 154(b) by 104 days.

(21) Appl. No.: 11/172,046

(22) Filed: Jun. 30, 2005

(65) Prior Publication Data

US 2006/0266319 A1 Nov. 30, 2006

Related U.S. Application Data

(60) Provisional application No. 60/683,909, filed on May 24, 2005.

(51) Int. Cl.
*F01L 1/34* (2006.01)

(52) U.S. Cl. ..... 123/90.18; 123/90.15; 123/90.17

(58) Field of Classification Search ..... 123/90.15, 123/90.16, 90.17, 90.18, 90.27, 90.31; 464/1, 464/2, 160; 29/888.1
See application file for complete search history.

(56) References Cited

U.S. PATENT DOCUMENTS 5,673,659 A * 10/1997 Regueiro ..... 123/90.17
6,216,654 B1 * 4/2001 Regueiro ..... 123/90.15

OTHER PUBLICATIONS

U.S. Appl. No. 10/821,331, unpublished, Mobley.

* cited by examiner

*Primary Examiner*—Ching Chang
(74) *Attorney, Agent, or Firm*—Ruden McClosky; Stanley A. Kim

(57) ABSTRACT

A variable valve timing system in which the cam shaft is rotated with respect to the crankshaft position by moving a shaft disposed interior to the cam shaft longitudinally has been developed. The variable valve timing system provides for varying the timing of the opening and closing of an engine's poppet valves (relative to the crankshaft angular position) to enhance the engine's efficiency and output. The timing system can be used with both intake and exhaust valves in both diesel and gasoline engines. The timing system is inexpensive to produce, and performs reliably over a lengthy period of time.

8 Claims, 2 Drawing Sheets

VARIABLE VALVE TIMING SYSTEM

CROSS REFERENCE TO RELATED APPLICATION

The present application claims the priority of U.S. provisional patent application No. 60/683,909, filed May 24, 2005.

FIELD OF THE INVENTION

The invention relates to the fields of mechanical engineering and internal combustion engines. More particularly, the invention relates to a variable valve timing system for use in internal combustion engines.

BACKGROUND

Systems exist for varying the valve timing in a four-stroke internal combustion engine. One such system, used in some Honda engines, is the Variable Valve Timing and Lift Electronic Control (VTEC) system. This is an electronic and mechanical system that allows the engine to have multiple camshafts. VTEC engines have an extra intake cam having its own rocker which follows the cam. The profile on this cam keeps the intake valve open longer than the valves in non-VTEC engines. At low engine speeds, a piston locks the extra rocker to the two rockers that control the two intake valves.

Another system for varying valve timing involves advancing the valve timing. By advancing the valve timing, the valves are opened later and closed later. This is accomplished by rotating the camshaft ahead a few degrees. If the intake valves normally open at 10 degrees before top dead center (TDC) and close at 190 degrees after TDC, the total duration is 200 degrees. The opening and closing times can be shifted using a mechanism that rotates the cam ahead a little as it spins. The valve, for example, might open at 10 degrees after TDC and close at 210 degrees after TDC. Closing the valve 20 degrees later is not optimal, and it would better to be able to increase the duration that the intake valve is open.

Several problems exist, however, for the systems described above. The Honda VTEC system, for example, harbors two disadvantages—the complexity of an additional cam shaft, with added rocker arms and piston/actuator assemblies, and the step function valve timing change (i.e., off/on) from one valve timing mode to the other. The complexity of the additional cam shaft confers additional production costs (additional components to be produced and assembled), and reduced reliability (additional components to wear/fail). Furthermore, this design is not amenable to retrofitting in existing engine/head designs because retrofitting would require a completely new head design for the engine to be retrofitted due to the VTEC's additional cam shaft assembly.

The problems associated with the step function valve timing change of the VTEC system include only one valve timing mode being available based upon the engine's speed (i.e., rotations per minute (RPMs)). At low speeds, one mode is available, while at some other speed the alternate timing mode is automatically selected. Therefore, only two engine speeds will afford optimum engine efficiency. All other engine speeds will suffer some degradation of efficiency. Thus, there is a need for an infinitely variable valve timing system which optimizes efficiency throughout the engine's RPM range and overcomes the problems associated with existing variable valve timing systems.

SUMMARY

The invention relates to the development of a variable valve timing system in which the cam shaft is rotated with respect to the crankshaft position by moving a shaft located within the cam shaft longitudinally. In a preferred embodiment, the variable valve timing system is used in combination with the desmodromic valve system described in U.S. patent application Ser. No. 10/821,331 but can also be easily applied to existing camshaft/poppet valve configurations. The variable valve timing system is most suitably adapted for application to a typical four-cycle internal combustion engine. The variable valve timing system provides for varying the timing of the opening and closing of an engine's poppet valves (relative to the crankshaft angular position) to enhance the engine's efficiency and output. The timing system can be used with both intake and exhaust valves. In preferred embodiments, the timing system is used in conjunction with a modern overhead cam engine configuration. The variable valve timing system of the invention can be used in both diesel and gasoline engines, is inexpensive to produce, and performs reliably over a lengthy period of time.

Accordingly, the invention features an internal combustion engine including (a) a crankshaft and (b) a variable valve timing system that includes a cam shaft and a shaft disposed interior to the cam shaft, whereby longitudinal movement of the shaft rotates the cam shaft with respect to the position of the crankshaft.

In another aspect, the invention features a motor vehicle including an internal combustion engine of the invention.

Within the invention is a variable valve timing system for an internal combustion engine having a crankshaft. This system includes a cam shaft that includes (a) a first shaft disposed interior to the cam shaft and operably connected to the crankshaft of the engine such that the first shaft rotates as the crankshaft rotates, (b) a second shaft including at least one groove, at least one slot, and a first end having an aperture, the second shaft disposed interior to the first shaft, (c) a third shaft disposed at least partially through the aperture of the first end of the second shaft including a means for moving the second shaft longitudinally, the third shaft moving longitudinally while the second shaft rotates about the third shaft, (d) a first securing means for fixing the second shaft rotationally to the first shaft and allowing the second shaft to move longitudinally with respect to the first shaft, the first securing means disposed through the first shaft and into the at least one groove of the second shaft, and (e) a second securing means for fixing the cam shaft rotationally to the first and second shafts, the second securing means disposed through the cam shaft and into the at least one slot of the second shaft. In this system, longitudinal movement of the second shaft urges the cam shaft to rotate relative to the first and second shafts and relative to the rotational orientation of the crankshaft.

In a system of the invention, the first shaft is operably connected to the crankshaft by a connecting means such as a pulley, sprocket, or Gilmer-type belt. The cam shaft can further include at least one cam shaft bearing that provides longitudinal support to the cam shaft. The means for moving the second shaft can include two bearings. The second shaft can include two grooves and the first securing means can include two pins. The second shaft can include two slots and the second securing means can include two pins.

Also within the invention is an internal combustion engine including a crankshaft and a variable valve timing system of the invention.

In another aspect, the invention features a motor vehicle including an internal combustion engine having a crankshaft and a variable valve timing system of the invention.

Unless otherwise defined, all technical terms used herein have the same meaning as commonly understood by one of ordinary skill in the art to which this invention belongs. Although systems, materials and devices similar or equivalent to those described herein can be used in the practice or testing of the present invention, suitable systems, materials, and devices are described below. All publications, patent applications, patents and other references mentioned herein are incorporated by reference in their entirety. In case of conflict, the present specification, including definitions, will control. In addition, the systems, materials, and devices are illustrative only and not intended to be limiting. Other features and advantages of the invention will be apparent from the following detailed description, and from the claims.

DETAILED DESCRIPTION

Figure 1:
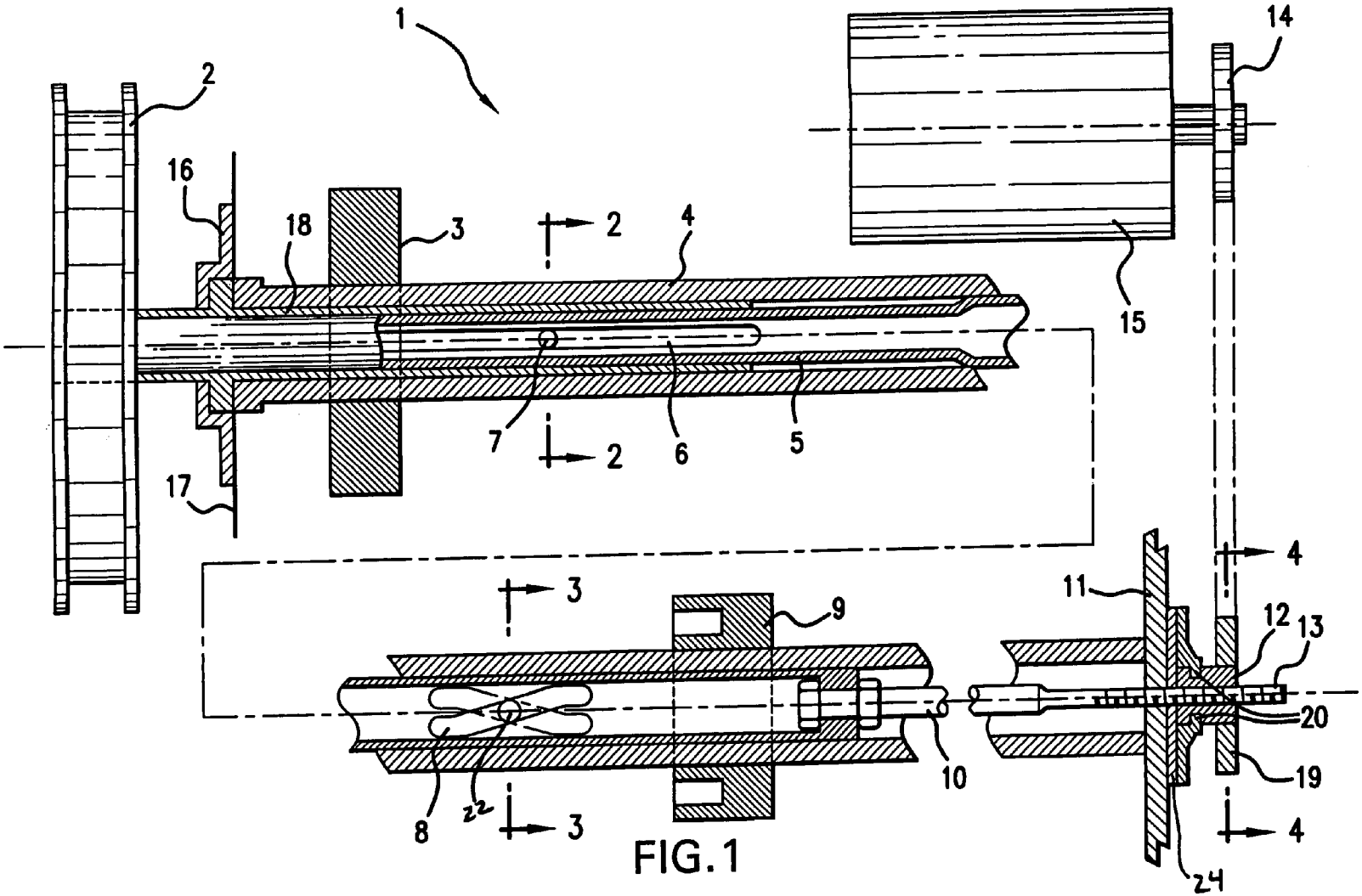
FIG. 1 is a cross-sectional side view of one aspect of the invention.
Figure 2:
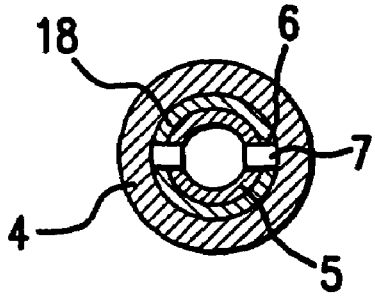
FIG. 2 is a cross-sectional view of the camshaft of FIG. 1, the cross-sectional view being of the section of the camshaft labeled 2.
Figure 3:
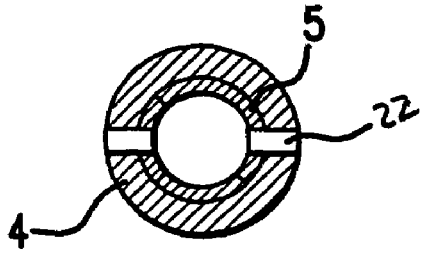
FIG. 3 is a cross-sectional view of the camshaft of FIG. 1, the cross-sectional view being of the section of the camshaft labeled 3.
Figure 4:
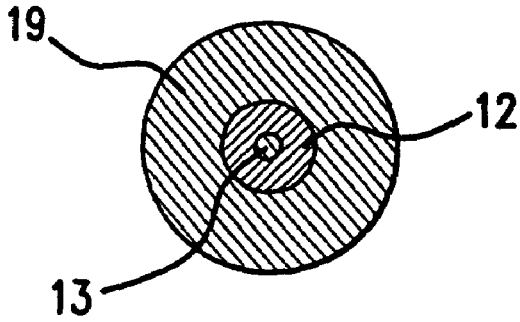
FIG. 4 is a cross-sectional view of the camshaft of FIG. 1, the cross-sectional view being of the section of the camshaft labeled 4.

In brief overview, referring to FIG. 1, an exemplary embodiment of a variable valve timing system 1 is shown. The variable valve timing system 1 involves a cam shaft 4 which is tubular in cross-section. The cam shaft 4 includes typical cam shaft bearings 3 that provide longitudinal support and cams 9 to actuate poppet valves. Inside the cam shaft 4 are three shafts (5, 10, and 18), two of which are tubular in cross-section (5 and 18). A pulley 2 (or other suitable means, e.g., sprocket), is fastened to the front end of first shaft 18, and is connected to the engine crankshaft's pulley (or other suitable means, e.g., sprocket) via a Gilmer-type belt or chain, depending upon the particular application or design of the engine. Therefore, first shaft 18 rotates as the engine's crankshaft rotates (typically, at ½ the crankshaft's speed). First shaft 18 contains a shoulder which becomes a bearing to prevent it from moving laterally inside the exterior surface 17 of the engine's head. This shoulder is captured externally by a circular fitting 16, which prevents the first shaft 18 from moving laterally out from the cam shaft 4.

Inside this tubular first shaft 18 is located a tubular second shaft 5. Second shaft 5 contains longitudinal grooves 6 which accept short pins 7 pressed into first shaft 18. This arrangement fixes second shaft 5 rotationally to first shaft 18, and allows second shaft 5 to move longitudinally with respect to first shaft 18. The external diameter of second shaft 5 increases at a point to fit against (with certain clearance) the internal surface of the cam shaft 4. Also, the internal diameter of first shaft 18, and the external diameter of second shaft 5 are both sized to provide sufficient clearance for longitudinal movement with respect to one another. Milled into second shaft 5 are two slots 8, one opposite the other on opposite sides of second shaft 5. These slots 8 are configured at an angle relative to the centerline of second shaft 5, and each slot 8 accepts one of two short pins 22 pressed through the cam shaft 4. These pins 22 and their corresponding slots 8 fix the cam shaft 4 rotationally to the first 18 and second 5 shafts. As second shaft 5 is moved longitudinally, in either direction, its angled slots 8 cause the camshaft 4, via the short pins 22, to rotate relative to first 18 and second 5 shafts, therefore relative to the crankshaft's angular position. In this manner, the timing of the opening and closing of the valves is changed relative to the crankshaft's rotational position.

The longitudinal movement of second shaft 5 is accomplished by the longitudinal movement of the third shaft 10. The right-ward end of second shaft 5 includes a shoulder through which is bored a hole to accept third shaft 10. This third shaft 10 contains two each bearings—one on each side of the shoulder of second shaft 5—to provide for moving second shaft 5 in either lateral direction. Third shaft 10 does not rotate with second shaft 5 and in fact, does not rotate at all. Rather, third shaft 10 moves longitudinally in either direction while second shaft 5 rotates about third shaft 10. At the opposite end of third shaft 10 from the bearings is a segment 13 of the third shaft 10 which is threaded. Along this segment 13, flats are milled on opposite surfaces. These flats are captured by bearing surfaces milled through the external wall 11 of the engine's head, thus preventing third shaft 10 from rotating. This passage through the head's outer wall 11 involves two parallel sides, closed at top and bottom by two semicircles. The parallel sides capture the flats milled onto third shaft 10, while the semicircular surfaces allow passage of the threaded and rounded surfaces of third shaft 10.

Cylinder 12 is a round cylinder that is threaded internally and that contains an external groove. This groove is captured by a flange 20 with seal 24, both of which are fastened to the external wall 11 of the head. Fastened to cylinder 12 is a first sprocket 19 (or pulley), which is driven in either direction by an electric motor 15 and a second sprocket 14 (or pulley). Turning cylinder 12 in either direction moves third shaft 10 laterally in one direction or the other, thus moving second shaft 5 longitudinally, and causing the cam shaft 4 to rotate with respect to the crankshaft's rotational position. Note that first sprocket 19 (or pulley) can be actuated/rotated using other means. For example, a rack and pinion arrangement, with the rack being actuated by either an electric motor or hydraulic mechanism could be substituted in this design. The results would be the same—i.e., third shaft 10 would be moved longitudinally in both directions.

The actuation of the electric motor 15, its direction of rotation to vary the valve timing, and the time duration of the motor's excitement can be determined experimentally to most effectively provide for increased engine efficiency. These parameters can be easily programmed into a modern engine's computer, which controls several other engine functions.

From the foregoing, it can be appreciated that the variable valve timing system of the invention provides for a virtually infinite number, between minimum and maximum limits, of valve timing variations, including increased or decreased timing durations, depending upon engine speed variations and other parameter changes as programmed into the engine's control computer. These timing variations are accomplished by turning the drive motor/mechanism in one direction or the other, by its duration of excitement, and can be performed within engine cycles, assuming the selected drive motor/mechanism is sufficiently responsive. These characteristics provide for a continuously optimum engine efficiency and output profile, as compared to current systems (e.g., step function systems), and/or systems which cannot dynamically alter valve opening durations. Thus, in comparison to conventional variable valve timing systems, those of the invention provide improved engine efficiency, output and reliability while simultaneously reducing manufacturing production costs.

While the above specification contains many specifics, these should not be construed as limitations on the scope of the invention, but rather as examples of preferred embodiments thereof. Many other variations are possible. For example, the actuation of the threaded shaft can be performed via several different means, including using a rack and pinion type arrangement. In this arrangement, a rack replaces the chain/gilmer belt, with the electric motor driving the rack toward/away from the threaded shaft. Or, the same could be accomplished using a hydraulic system similar to a small power steering system arrangement. High-pressure engine oil from the engine's oil pump, for example, can provide sufficient power to energize a hydraulic actuation system. Further, a vacuum system, whose source can be the engine's air intake manifold, can provide adequate power (e.g., via vacuum solenoids) for the system's actuation. Accordingly, the scope of the invention should be determined not by the embodiments illustrated, but by the appended claims and their legal equivalents.

What is claimed is:

1. A variable valve timing system for an internal combustion engine having a crankshaft, the system comprising a cam shaft comprising:

(a) a first shaft disposed interior to the cam shaft and operably connected to the crankshaft of the engine such that the first shaft rotates as the crankshaft rotates;

(b) a second shalt comprising at least one groove, at least one slot, and a first end having an aperture, wherein the second shaft is disposed interior to the first shaft;

(c) a third shaft disposed at least partially through the aperture of the first end of the second shaft comprising a means for moving the second shaft longitudinally, wherein the third shaft moves longitudinally while the second shalt rotates about the third shalt;

(d) a first securing means for fixing the second shaft rotationally to the first shaft and allowing the second shaft to move longitudinally with respect to the first shaft, the first securing means disposed through the first shall and into the at least one groove of the second shaft; and (e) a second securing means for fixing the cam shaft rotationally to the first and second shafts, the second securing means disposed through the cam shaft and into the at least one slot of the second shaft, wherein longitudinal movement of the second shaft urges the cam shaft to rotate relative to the first and second shafts and relative to the rotational orientation of the crankshaft.

2. The variable valve timing system of claim 1, wherein the first shaft is operably connected to the crankshaft by a connecting means selected from the group consisting of: pulley, sprocket, and Gilmer-type belt.

3. The variable valve timing system of claim 1, the cam shaft further comprising (f) at least one cam shaft bearing that provides longitudinal support to the cam shaft.

4. The variable valve timing system of claim 1, wherein the means for moving the second shaft comprises two bearings.

5. The variable valve timing system of claim 1, wherein the second shaft comprises two grooves and the first securing means comprises two pins.

6. The variable valve timing system of claim 1, wherein the second shaft comprises two slots and the second securing means comprises two pins.

7. An internal combustion engine comprising a crankshaft and a variable valve timing system, the variable valve timing system comprising a cam shaft comprising:

(a) a first shaft disposed interior to the cam shaft and operably connected to the crankshaft of the engine such that the first shaft rotates as the crankshaft rotates;

(b) a second shaft comprising at least one groove, at least one slot, and a first end having an aperture, wherein the second shaft is disposed interior to the first shaft;

(c) a third shaft disposed at least partially through the aperture of the first end of the second shalt comprising a means for moving the second shaft longitudinally, wherein the third shaft moves longitudinally while the second shaft rotates about the third shaft;

(d) a first securing means for fixing the second shaft rotationally to the first shaft and allowing the second shalt to move longitudinally with respect to the first shalt, the first securing means disposed through the first shaft and into the at least one groove of the second shaft; and (e) a second securing means for fixing the cam shaft rotationally to the first and second shafts, the second securing means disposed through the cam shaft and into the at least one slot of the second shaft, wherein longitudinal movement of the second shaft urges the cam shaft to rotate relative to the first and second shafts and relative to the rotational orientation of the crankshaft.

8. A motor vehicle comprising an internal combustion engine having a crankshaft and a variable valve timing system, the variable valve timing system comprising a cam shaft comprising:

(a) a first shalt disposed interior to the cam shaft and operably connected to the crankshaft of the engine such that the first shaft rotates as the crankshaft rotates;

(b) a second shaft comprising at least one groove, at least one slot, and a first end having an aperture, wherein the second shaft is disposed interior to the first shaft;

(c) a third shalt disposed at least partially through the aperture of the first end of the second shaft comprising a means for moving the second shaft longitudinally, wherein the third shaft moves longitudinally while the second shalt rotates about the third shaft;

(d) a first securing means for fixing the second shaft rotationally to the first shaft and allowing the second shaft to move longitudinally with respect to the first shaft, the first securing means disposed through the first shaft and into the at least one groove of the second shaft; and (e) a second securing means for fixing the cam shaft rotationally to the first and second shafts, the second securing means disposed through the cam shaft and into the at least one slot of the second shaft, wherein longitudinal movement of the second shaft urges the cam shaft to rotate relative to the first and second shafts and relative to the rotational orientation of the crankshaft.

* * * * *